US011912466B2

(12) United States Patent
Taylor et al.

(10) Patent No.: US 11,912,466 B2
(45) Date of Patent: Feb. 27, 2024

(54) FUEL CONTAINER

(71) Applicant: B & T Products Ltd., London (GB)

(72) Inventors: Peter Taylor, Dorset (GB); James Butler, Dorset (GB)

(73) Assignee: B & T Products Ltd., London (GB)

( * ) Notice: Subject to any disclaimer, the term of this patent is extended or adjusted under 35 U.S.C. 154(b) by 74 days.

(21) Appl. No.: 17/606,436

(22) PCT Filed: Apr. 30, 2020

(86) PCT No.: PCT/IB2020/054085
§ 371 (c)(1),
(2) Date: Oct. 25, 2021

(87) PCT Pub. No.: WO2020/222160
PCT Pub. Date: Nov. 5, 2020

(65) Prior Publication Data

US 2022/0194663 A1 Jun. 23, 2022

(30) Foreign Application Priority Data

Apr. 30, 2019 (GB) ..... 1906032
Dec. 24, 2019 (GB) ..... 1919319

(51) Int. Cl.
*B65D 25/28* (2006.01)
*B65D 25/42* (2006.01)
*B65D 25/48* (2006.01)

(52) U.S. Cl.
CPC ..... *B65D 25/48* (2013.01); *B65D 25/2894* (2013.01); *B65D 25/42* (2013.01); *B65D 2205/02* (2013.01)

(58) Field of Classification Search
CPC .... B65D 25/48; B65D 25/2894; B65D 25/42; B65D 2205/02
See application file for complete search history.

(56) References Cited

U.S. PATENT DOCUMENTS 5,069,260 A * 12/1991 Shea ..... B67D 7/54 141/351
5,597,097 A 1/1997 Morris
(Continued)

FOREIGN PATENT DOCUMENTS

DE 202007010406 11/2008
DE 202010012365 11/2010
(Continued)

OTHER PUBLICATIONS (ISA/237) Written Opinion of the International Search Authority and International Search Report for International Patent Application No. PCT/IB2020/054085, mailed by the EPO dated Sep. 17, 2020.

*Primary Examiner* — Frederick C Nicolas
(74) *Attorney, Agent, or Firm* — William H. Bollman

(57) ABSTRACT

A fuel container having a body defining a volume for receiving fuel. The body has an inlet and optionally a vent. The inlet extends upwards as a spout and has a threaded collar which is closed by a threaded cap. A gas expansion pathway is provided between the inlet and the vent. The spout has a guide for receiving and locating a dog-leg portion of a fuel dispenser nozzle. A restriction in the throat of the spout prevents the fuel dispenser nozzle from being inserted beyond a preselected distance into the container thereby preventing backwash and spillage.

19 Claims, 13 Drawing Sheets

(56) References Cited

U.S. PATENT DOCUMENTS

| | | | | |
|---|---|---|---|---|
| 6,029,858 | A | 2/2000 | Srokose et al. | |
| 6,036,061 | A | 3/2000 | O'Donnell | |
| 6,068,163 | A * | 5/2000 | Kihm | B67D 7/72 222/530 |
| 7,959,044 | B1 | 6/2011 | Christian et al. | |
| 2014/0332568 | A1* | 11/2014 | Stratton | B65D 47/32 222/481.5 |
| 2021/0114771 | A1* | 4/2021 | Winthrop | B65D 21/0238 |

FOREIGN PATENT DOCUMENTS

| | | |
|---|---|---|
| FR | 2499943 | 8/1982 |
| GB | 2343443 | 5/2000 |
| WO | 20070253378 | 3/2007 |
| WO | 2010032115 | 3/2010 |

* cited by examiner

FUEL CONTAINER

FIELD OF THE INVENTION

The present invention relates to a fuel container, can or canister, hereinafter referred to as a fuel container. In particular the invention relates to a fuel container for storing and dispensing petrol, diesel or similar liquid fuel. More particularly it relates to portable fuel containers which typically hold 5 litres to 25 litres of liquid fuel when full.

BACKGROUND

When filling fuel containers fuel blowback or back wash occurs when there is an airlock in the fuel container and the blowback or backwash can give rise to spillage. This problem is exacerbated at higher flow rates. Automatic fuel pumps that dispense liquid fuel therefore need to be operated carefully when dispensing into a fuel can or container, and at low speeds, in order to avoid fuel blowback or back wash. This results in a user spending longer at a fuel dispensing pump than is desirable.

Filling liquid fuel containers was often problematic because the user was not always able to gauge the level of fuel in the fuel container during filing as fuel containers are usually opaque and therefore again a user tended to dispense fuel very slowly as a precaution against backwash. This problem was exacerbated in low light or when it was dark.

Likewise emptying liquid fuel containers was problematic as spillages sometimes arose due to glugging which occurred as a result of airlocks or a partial vacuum in the container that caused the contents being poured to 'glug' when they were not vented by a continuous air flow.

Nowadays most fuel dispensing pumps, such as those at consumer roadside fuel filing stations, have hoses connected to fuel nozzles which shut off fuel automatically by way of a Venturi effect which triggers a shut off valve when fuel in a fuel tank of a vehicle reaches an opening on the fuel nozzle. Fuel spillages occur when filling fuel containers before the shut off valve is triggered. This resulted in fuel overflowing from the fuel container before pumping stopped which caused waste, polluted the environment and presented a flammable hazard.

Therefore as the Venturi effect did not always trigger the shut off valve, fuel nozzles did not always cause fuel to be shut off at the correct level in the fuel container being filled. This led to fuel flowing over the fuel container and its handle and as a consequence unpleasant fumes in a vehicle.

In order to avoid these problems the user either had to fill the fuel container very slowly or under fill the fuel container. The former resulted in additional time to fill the container and the latter resulted in the fuel container being filled to less than its full capacity.

Another problem that occurred during filling of a fuel container was caused by the user having to lift and orient the fuel container to receive the dispenser nozzle because most modern fuel dispensers have a kink or a dog-leg nozzle towards the end of the fuel nozzle so that the tip portion is bent off axis of the main dispenser nozzle. This dog-leg or kink was sometimes referred to as a knuckle and was a bend at an angle in the dispenser nozzle designed to be placed into an inlet to a full tank of a vehicle.

The nozzles are usually colour-coded to indicate which type of fuel they dispense. Different types of fuel dispensers have specially sized nozzles to prevent accidentally filling a tank with an incompatible fuel. For example nozzles on diesel (derv) pumps are usually larger than those for dispensing leaded or unleaded petrol (gasoline) so that they do not fit into a filler pipe of a vehicle tank designed for petrol (gasoline). However, the larger diameter diesel nozzles are not an actual requirement, and many diesel pumps at auto islands have been fitted with standard gasoline nozzles.

Trying to hold the fuel container at a correct angle whilst also lifting the fuel nozzle and hose increased the chance of spillages and was not always easier for users especially if they were frail or infirm. This was due to the strain and discomfort caused to the person who usually had to hold the fuel container in one hand and tilt it whilst supporting the weight of a petrol pump hose and the dispenser nozzle in the other, orienting it to the fuel nozzle and controlling a fuel dispensing trigger. As mentioned earlier this was particularly difficult for frail or elderly users to carry out alone and unaided.

PRIOR ART

GB 2 483 850 (IQBAL) discloses a portable liquid fuel container which stores flammable liquid fuel. The assembly includes a hollow spout to permit fluid communication in use through the pouring hole and along the spout passage.

U.S. Pat. No. 5,226,574 (DURINZI) discloses a gasoline container, moulded integrally of plastic, has a top fill opening and a top, diagonally upwardly extending pouring spout, preferably with handle regions moulded into the container itself.

U.S. Pat. No. 3,746,200 (FLIDER) discloses an all-plastic "Jerry Can" is made with a recessed handle and a screw-top opening. A breather tube extends from a higher region of the fuel can.

US-A1-2015210446 (WILKINS) discloses a portable container for liquids. It comprises a fill port extending upwards at an angle and a dispensing aperture on opposing sides.

U.S. Pat. No. 5,226,574 (DURINZI) discloses a portable fuel can tank having a flexible dispensing nozzle.

U.S. Pat. No. 4,069,946 (FLIDER) discloses a container having a fill opening on the top surface and a pour opening. The fill opening extends away at an angle from the pour opening.

Likewise U.S. Pat. No. 6,036,061 (O'DONNELL) discloses a fluid container wherein an opening extends away at a 45-degree angle relative to the top surface.

French Patent number FR-B-2 499 943 (SEPROSY) discloses a blow moulded container with an integral hollow handle and a spout extending upwards from a top of the container.

International Patent application WO-A-2010/032115 (EATON) discloses an overfill prevention device that prevents overflow of a fluid storage tank. The overfill prevention device includes a filler cup designed to fit within the fill opening of the tank body.

International Patent application WO-A-2007/025378 (EXCON DEVELOPMENT) discloses a flow control valve which is operable through a twisting motion of a lifting handle. The valve is biased to return to a closed state when the handle is released in order to seal the container and prevent accidental fluid leakage.

German DE-U-20 2010 012 365 (Erhard & Sohne) discloses a portable canister for storing urea. The urea is mixed with exhaust gasses to reduces pollutants. The cannister stores the urea for use as an after-treatment to reduce nitrogen dioxide levels of exhaust gases.

The present invention arose in order to overcome problems suffered by existing fuel containers.

An object of the invention is to provide a liquid fuel container which can be filled quickly without spillage due to back wash.

Another aim is to provide a fuel container that can be filled easily without spillage, thereby improving forecourt safety at petrol filling stations.

Another aim of the invention is to provide a fuel container that can be easily filled to a preselected level in a single attempt of depressing a trigger of a fuel pump gun.

SUMMARY OF THE INVENTION

According to a first aspect of the present invention there is provided a fuel container comprising: a body for receiving fuel, the body has a handle and an inlet with a neck that extends upwards and is arranged at an angle with respect to an upper surface of the body and has a threaded collar which is closable by a threaded cap, the length of the neck from its opening to the upper surface of the body defines a guide for receiving and orienting a dog-leg part of a fuel dispenser nozzle in order to prevent the fuel dispenser nozzle from twisting when fully inserted in the neck; and a shoulder is provided against which the dog-leg nozzle rests; the guide and the shoulder orient and locate the dog-leg part of the nozzle, at a preselected distance within the neck, so that an upper surface of liquid fuel dispensed in the container causes a Venturi shutoff mechanism to trigger at a predefined volume of dispensed fuel.

The body receiving the fuel ideally has a handle formed integrally therewith. In a preferred embodiment the handle is formed with the fuel container by a blow moulding process. Optionally the handle has a grip, for example one which is made from a rubberised material, to ease carrying.

Preferably the neck extends upwards, pointing away from the rear of the container, as a spout from the body at an angle between 35° and 75° with respect to the horizontal upper surface of the body.

Ideally the length of the neck from its opening, to the upper surface of the body, is between 50% and 99% of the length of a dog-leg nozzle end of a fuel dispenser nozzle. For diesel fuel dispensing nozzles, this is equivalent to between 5.5 and 11.0 centimetres preferably between 6.0 and 10.0 centimetres. For petrol fuel dispensing nozzles, this is equivalent to between 5.5 centimetres and 11.0 centimetres preferably between 7.0 centimetres and 9.5 centimetres.

Therefore the length of the neck is between 4.5 centimetres and 7.5 centimetres and ideally substantially 6 centimetres in length.

The guide for receiving and orienting the dog-leg nozzle prevents the fuel dispenser nozzle from twisting when fully inserted in the neck in some embodiments by way of a narrowing throat portion which is dimensioned to receive the diameter of either a diesel fuel or a petrol fuel dispensing nozzle. The throat may be defined by one or more raised portions or ribs extending along the neck and thereby causing it to reduce in diameter and thereby prevent lateral and rotational movement of the nozzle when fully inserted into the neck.

Ideally the shoulder comprises a thicker portion of material that acts as an end stop against which the tip of the nozzle rests. In some embodiments the end stop against which the dog-leg nozzle rests is defined by an internal region of the handle. In another embodiment the end stop may be formed integrally on an inner surface of the body of the fuel container. In other embodiments the end stop may be defined by a circular or ring shaped projection dimensioned and arranged to abut the tip of the nozzle.

Together the guide and the shoulder locate and position the dog-leg nozzle at an optimum distance from an upper level of the surface of fuel when the container is full to its specified volume. At this optimum distance, from a maximum filling level when fuel reaches an upper liquid fuel level in the container, dispensing of further fuel is prevented as the Venturi shutoff mechanism has triggered.

In addition the guide and the shoulder orient the fuel dispenser nozzle ensuring it can only be inserted fully into the neck in one orientation. This not only ensures the nozzle can only be inserted in one way but also assists the user by enabling a user to rest the fuel container on level ground and so improve stability when filling the can and in order to ensure the can is filled to its correct maximum volume.

Optionally spaces or gaps are provided in the neck to allow air displaced from the fuel container to escape without causing pressure build up, thereby ensuring a smooth filling experience under normal atmospheric pressure, because pressure build up is avoided by the venting effect of the gaps.

The invention therefore prevents spillages occurring due to backwash because the fuel nozzle is located and held in an optimum position to ensure the Venturi valve is triggered at exactly the desired volume. Therefore even when fuel is dispensed rapidly there is no backwash forcing fuel from the container before the shut-off valve in the fuel dispenser is activated because there is a gap of several centimetres between a maximum liquid level height and the opening of the neck.

There is a bend approximately half way along the length of the neck, from its opening, to the shoulder. The dog-leg nozzle end of the fuel dispenser nozzle rests against this bed. The narrowing diameter of the neck to a throat portion, the bend in the neck and the shoulder all help to guide and orient the dog-leg nozzle end of the fuel dispenser and help prevent it from twisting when fully inserted. Therefore the fuel pump dispenser nozzle is always located at the precise distance from the upper surface of the fuel. In this configuration flow of fuel from the pump is immediately stopped when the precise maximum level of fuel is reached.

Thus the guide and end stop in the neck or spout receive and locate the petrol pump dispenser nozzle and enable the user to fill a fuel container quickly and without back wash.

An advantage of having an angle or kink or bend in the neck is that it arrests the dog-leg portion of the fuel dispenser nozzle. The neck therefore helps define a guide for receiving and orienting the dog-leg nozzle end in order to prevent the fuel dispenser nozzle from twisting when fully inserted in the neck. A shoulder is provided between the kink and an upper surface of dispensed fuel. The shoulder assists in the orientation and location of the dog-leg nozzle at a preselected distance within the container and helps to prevent the fuel dispenser nozzle from twisting.

Once filled and the cap placed on the opening, the fuel container may be transported and stored without any vapours or smells occurring as there is no longer any spillage.

Ideally the inlet has a larger internal diameter than a standard fuel dispenser nozzle and receives the fuel dispenser nozzle to fill the container with liquid fuel. The inlet is also used to pour the liquid fuel from the container.

Preferably a vent, also known as a Chiltern valve or cap, is provided and functions as an air vent during emptying of the liquid fuel from the container. The vent or Chiltern valve or cap acts as a siphon that allows air to flow into the container and helps prevent so called glugging. As air enters the container through the vent the liquid fuel pours smoothly and continuously from the container.

The arrangement enables the inlet to support the nozzle at an optimal angle and locates a nozzle opening at a correct location in the container to where the fuel fills the container. Automatic fuel shutoff by the Venturi effect is thereby enabled when the fuel dispenser nozzle is in the inlet channel.

The container may comprise wholly displaceable screw lids or caps. Such lids may be connected or tethered to the container to avoid loss.

In some embodiments the vent has a cap and during pouring of the liquid fuel from the container, the cap is removed or opened so that air passes through the vent while fuel pours out of the container through the fuel inlet. This helps prevent fuel glugging.

In some embodiments the fuel container has an integrally formed handle for carrying or lifting the container. Optionally a contoured pattern or other grip may be formed with the handle.

In some embodiments the fuel container comprises a fuel expansion zone, which expansion enables gas or fumes to expand when the internal volume is filled. In this way the expansion zone may be separate to, but in fluid connection with, an internal volume. The fluid expansion zone is ideally located above the internal volume.

For example, the fluid expansion zone may be defined in the handle. For example, the handle may comprise a hollow structure in which fumes or gas may expand. In this way, for example the fuel dispenser nozzle may be inserted into the fuel inlet and the internal volume filled up to the full level of the container, below a neck leaving the first pathway open for gas expansion as well as enabling air to be displaced from the container during filling, thereby avoiding airlocks.

The body is ideally formed from a thermoplastic or thermoset polymer or a metal or alloy material which is also the case for the cap which seals the container at the spout. In some embodiments the container is formed as a single mould, for example by blow moulding, from a thermoplastics material, such as acrylonitrile butadiene styrene (ABS) or high-density polyethylene (HPDE).

A preferred embodiment of the invention will now be described by way of example only and with reference to the Figures in which:

DETAILED DESCRIPTION OF PREFERRED EMBODIMENTS

Figure 1:
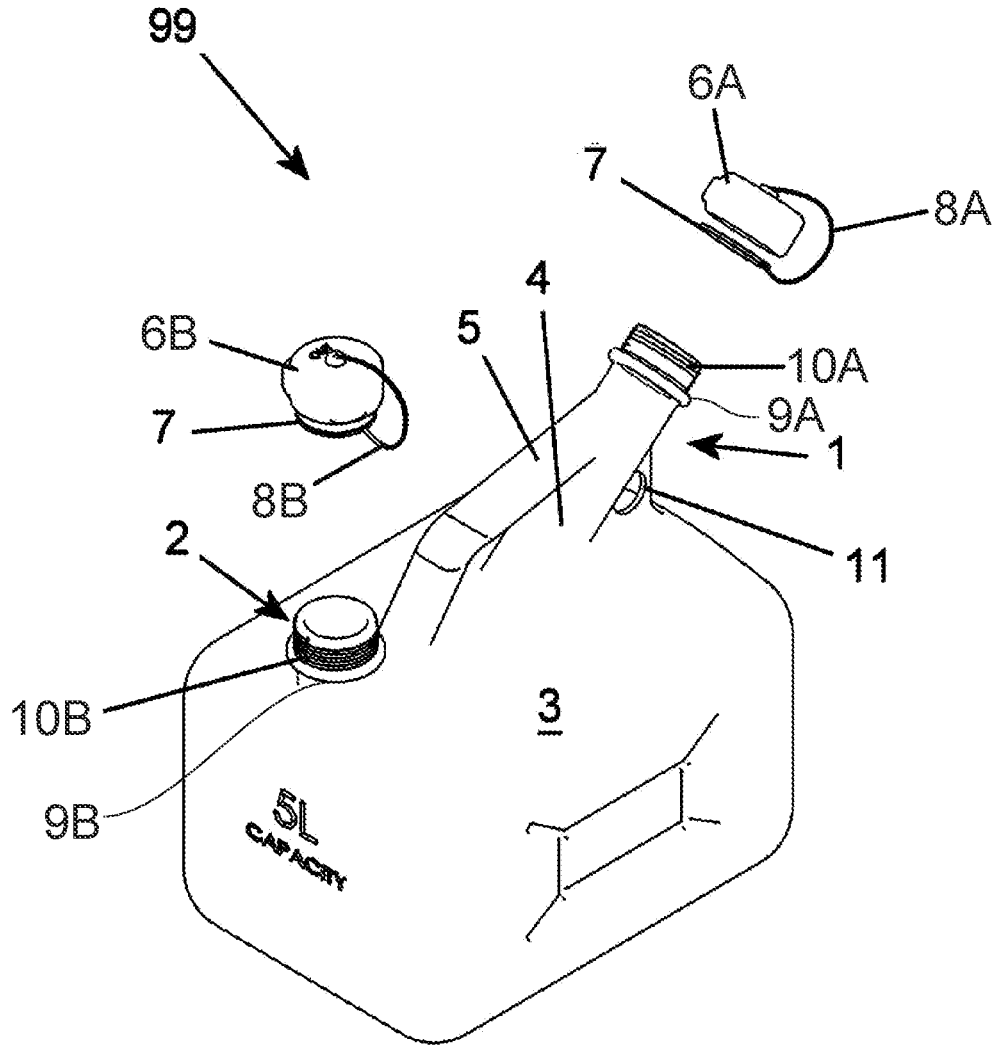
FIG. 1 shows an overall view of one embodiment of the fuel container.

With reference to the Figures there are shown different embodiments of a fuel container 99 with a body 3 that defines an internal volume 71 for receiving and storing fuel. The body 3 of the container shown in FIG. 1 is substantially cuboid. The embodiments shown in the Figures are formed from a robust, rigid thermoplastics material that is formed by way of a blow moulding process.

Handle 5 has one end 66 that is connected to the body 3 and the other handle end 67 is connected to the neck 4. The handle 5 is shaped so as to enable the user to grasp their hand around the handle when carrying the container.

In some embodiments the handle 5 is hollow and defines a fluid pathway which acts as a gas expansion volume which may typically be between 10% to 15% of the internal volume of the container.

An inlet 1 is defined at the end of a neck 4 that extends upwards and away from the body 3 of the fuel container 99 at an angle between 35° and 75° with respect to an upper surface of the body 3.

The inlet 1 and neck 4 are dimensioned and shaped to receive a first tubular portion 82 of a fuel dispenser nozzle 85 so that fuel can be pumped into the body 3. The inlet 1 is shaped, for example it is fluted or has rifling, so that air may vent as fuel enters the container 99.

The body 3 has a base 43 which rests on the ground as the container 99 is being filled. A vent 2 is located on an opposite side of the top face of the body 3 to the inlet 1. The body has a larger base surface area than the surface area of its upper surface to improve the stability of the container.

The neck 4 has a collar 9A with thread 10A for receiving a cap 6A. The vent 2 also has a thread 10B on its collar 9B for receiving a cap 6B. In an alternative embodiment a one-way valve may replace the cap 6B as described below. Threaded collars 9A and 9B enable the connection of lids or caps 6A and 6B respectively.

The lids or caps 6A and 6B are respectively connected to the collars by way of tethers 8A and 8B which ensure the caps do not get lost.

The inlet 1 comprises a neck 4 angled upwards from the top face of the body 3. In this way a fuel dispenser nozzle 85 may be inserted into the neck and located therein as described below, without requiring the user to lift or tip the fuel container 99, as was the case with previous fuel containers.

Optionally the neck 4 is supported below by way of a fillet or a perforated brace 11 which provides strength and prevent the neck from collapsing. A lanyard attachment point, for example for an identification tag (not shown) or for hanging on a hook for storage purposes, may be formed in the brace 11.

The neck 4 is angled between 35° and 75° with respect to the top of the fuel container 99. This enables the Venturi effect to trigger a shut off valve (not shown) in the fuel nozzle 85 when liquid fuel reaches a maximum filling level in the container, as described below.

Figure 2:
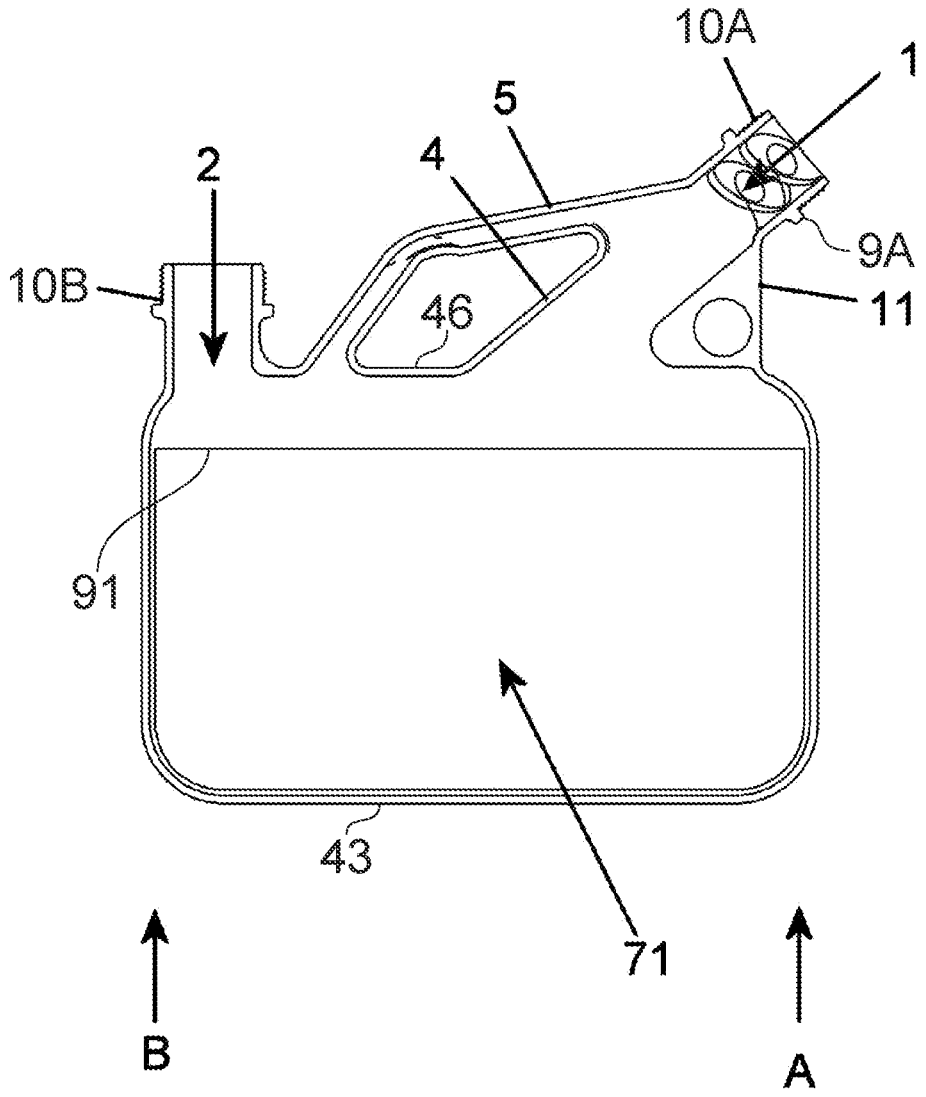
FIG. 2 shows an overall view of one embodiment of the fuel container with an Archimedean screw in its spout to assist in pouring contents from the fuel container.

In the examples shown in FIGS. 1 to 11B and FIG. 13, the neck 4 is arranged at substantially 45° with respect to the top surface 46 of the container 99. The embodiment shown in FIG. 2 is a fuel container with an Archimedean screw in its spout to assist in pouring contents from the fuel container and enable air to vent into the container, thereby ensuring a smooth discharge of the liquid contents. The Archimedean screw also assists in locating the fuel dispensing nozzle and helps immobilise the fuel dispensing nozzle when inserted in the neck of the container.

Figure 3:
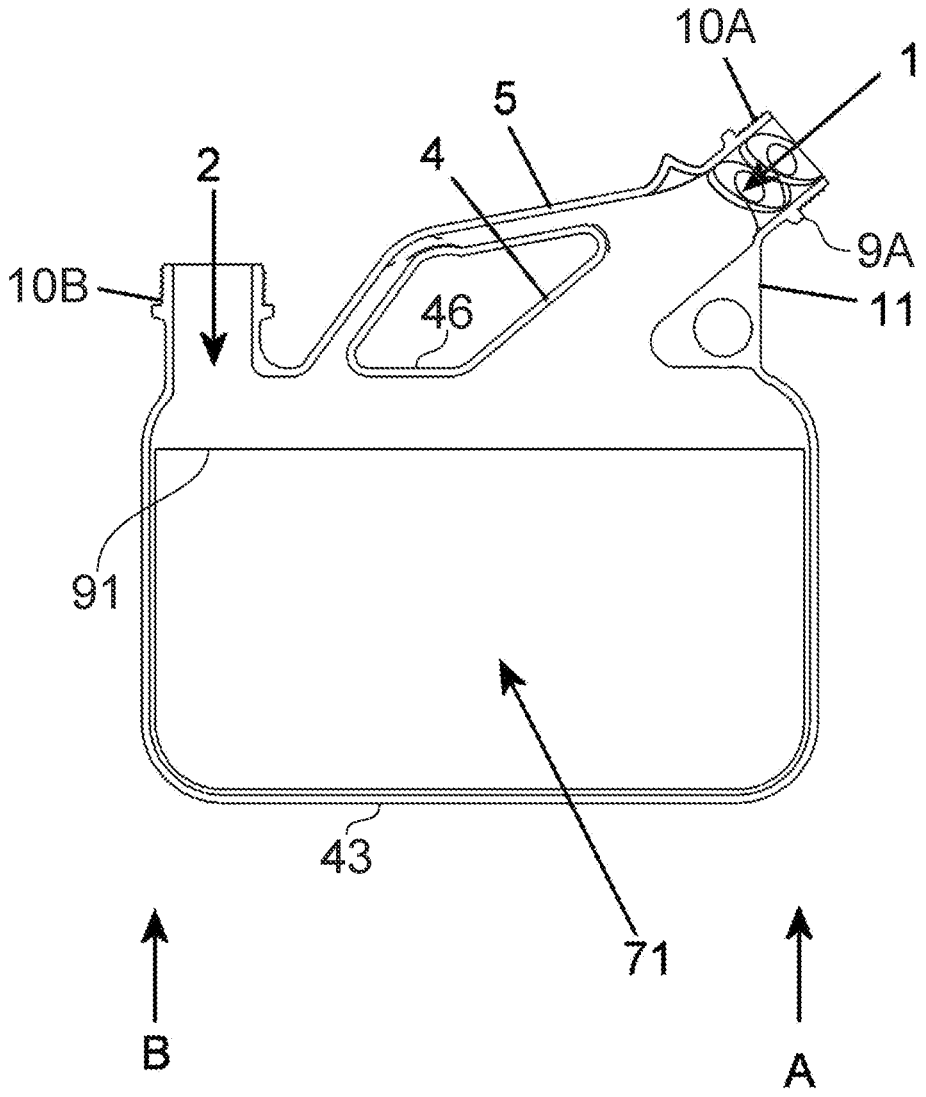
FIG. 3 shows an overall view of one embodiment of the fuel container with a grip on its upper handle to assist gripping the container during filling.
Figure 4A:
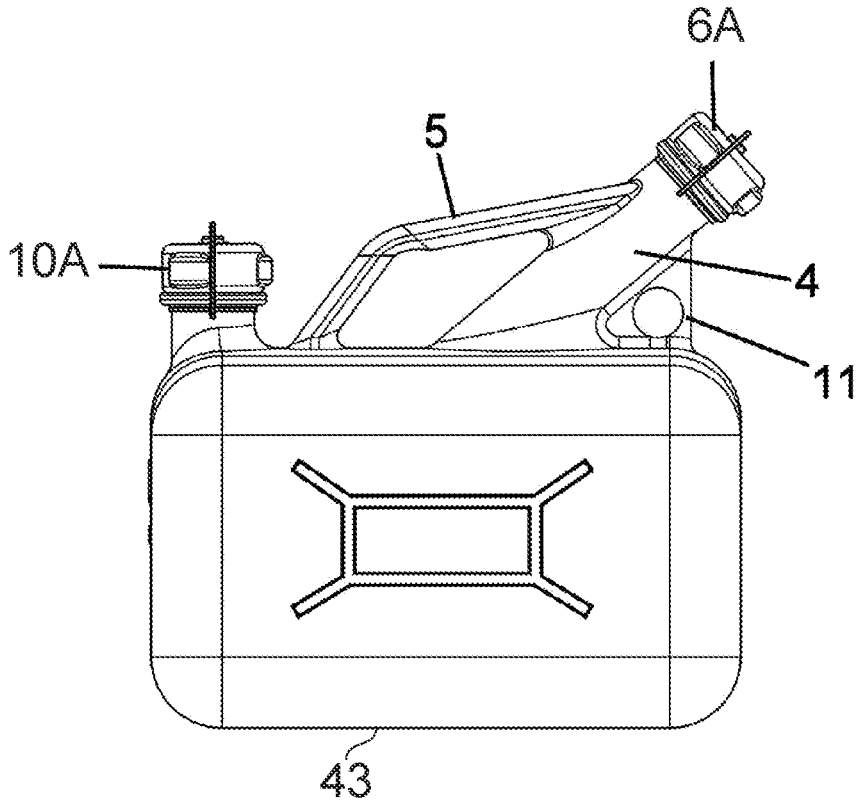
FIG. 4A shows a side view of the embodiment shown in FIG. 1.
Figure 4B:
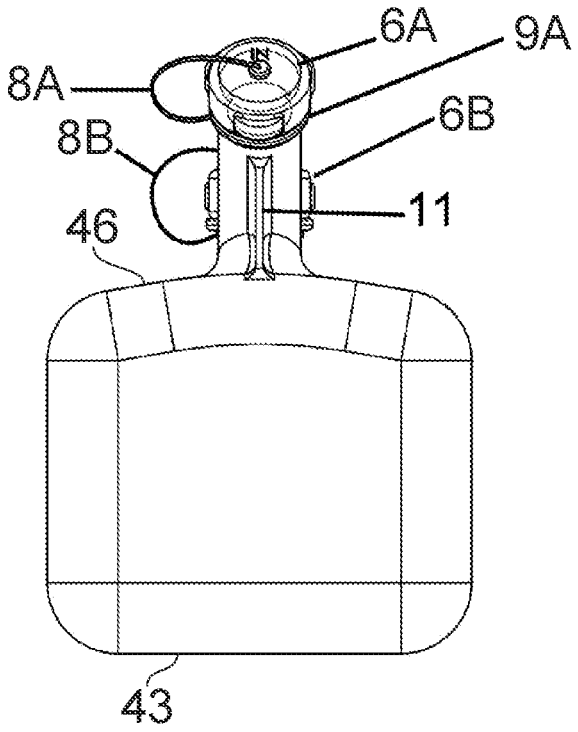
FIG. 4B shows an end view from the embodiment shown in FIG. 1.
Figure 5:
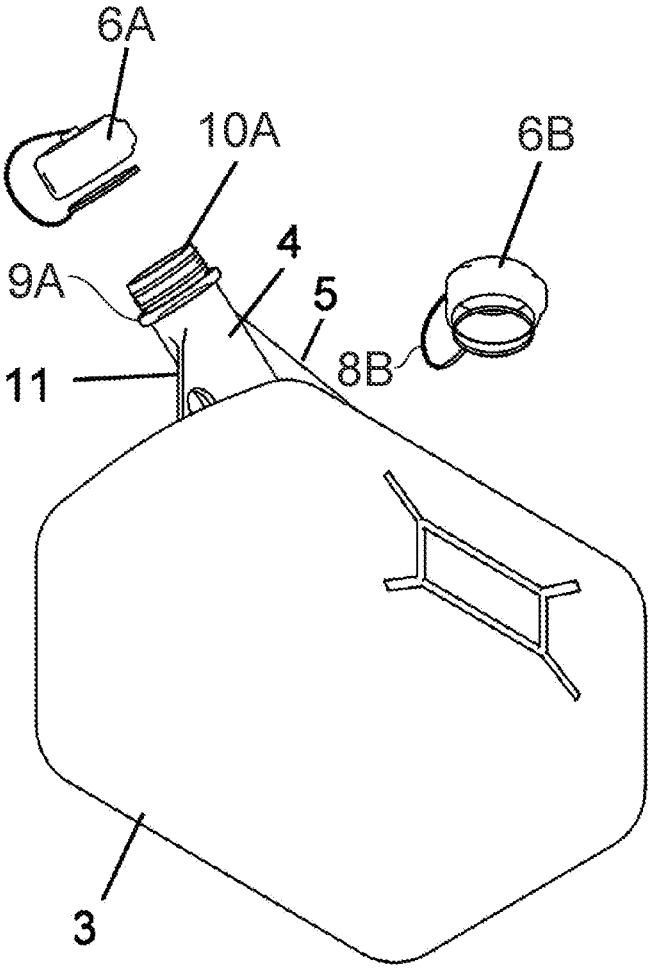
FIG. 5 shows an under plan view of the embodiment shown in FIG. 1.

The embodiment shown in FIG. 3 is a fuel container with a grip on its upper handle to assist gripping the container during filling.

As shown in FIGS. 4, 5, 6, 9 and 13, the neck 4 supports the fuel dispenser nozzle (not shown) in the neck 4. The dog-leg in the junction of the container and neck 4 ensures the fuel dispenser nozzle is located at the precise position where the level of the maximum fuel level distance Venturi effect to trigger the automatic shutoff valve in the fuel dispenser nozzle when the level of liquid inside the container volume 3 reaches full level 91. This is shown in greater detail in FIG. 13.

Figure 13:
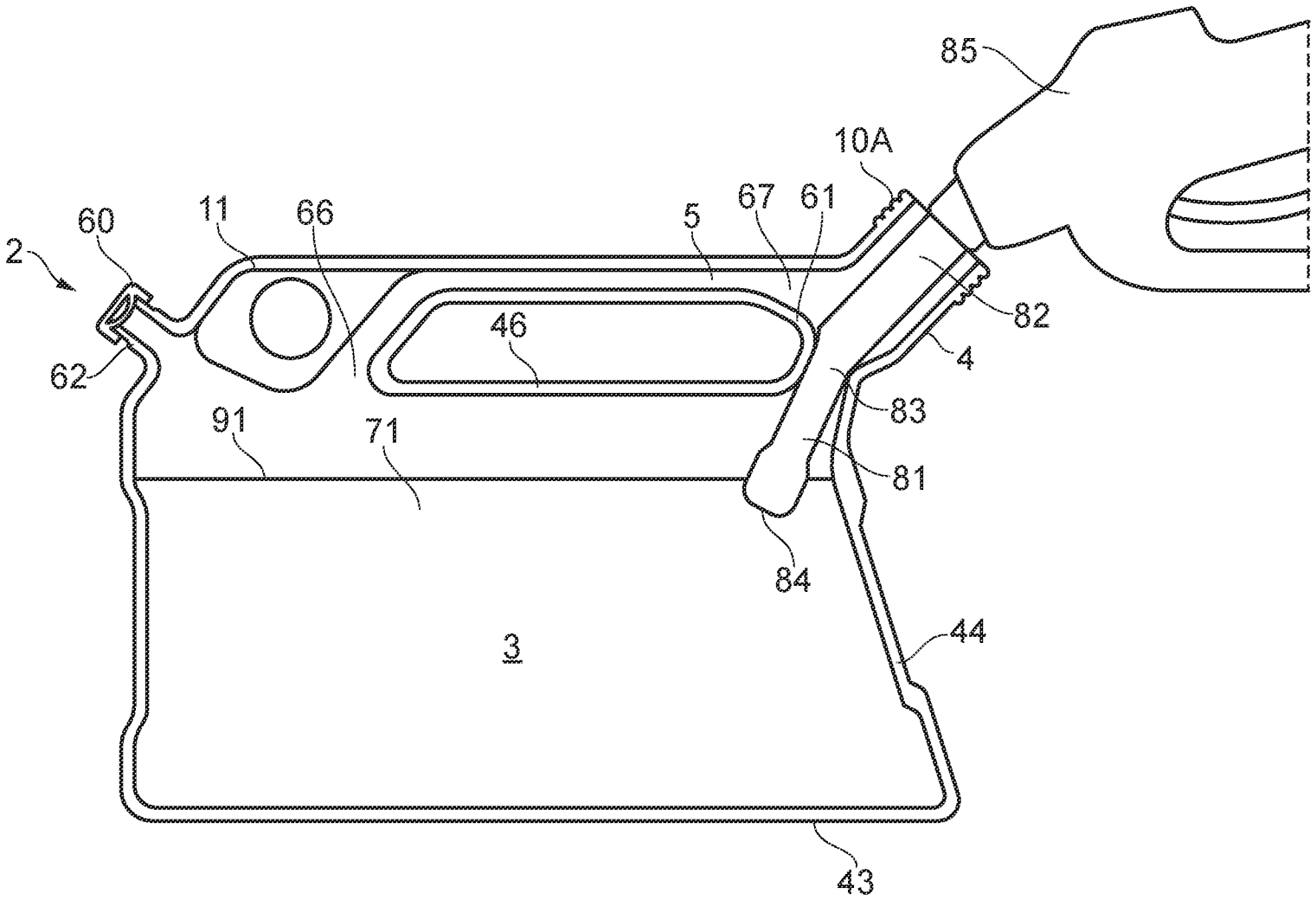
FIG. 13 shows another embodiment of the container wherein the handle is connected at distal ends to the body and the inlet.

Referring to FIG. 13, the length of the neck 4 is slightly less than the total length of a standard fuel dispenser nozzle. The total length of the fuel dispenser nozzle includes a first tubular portion 82 extending from handle 85 and a second tubular portion 81 extending from the first tubular portion.

Typically, for a petrol dispenser, these portions are between 5.5 centimetres and 11.0 centimetres and preferably between 7.0 centimetres and 9.5 centimetres in length. When fully inserted nozzle 84 is positioned and retained by the angled neck 4 and the shoulder 61. When oriented and located in this way the nozzle 84 is presented to dispense fuel to a limit defined by an upper fuel level indicator 91 of the container 99. The fuel dispenser nozzle is retained and prevented from twisting by the cooperation of the shoulder 61 and narrowing of the inlet in the neck 4.

In use the heavy fuel gun 85 rests on threaded lip portion 10A of the neck 4. To help prevent the weight of the fuel nozzle tipping over the container body 3 sides 44 of the body 3 taper to a wider footprint or base 43, thereby helping to ensure stability of the fuel container or can when resting on the ground.

Figure 6:
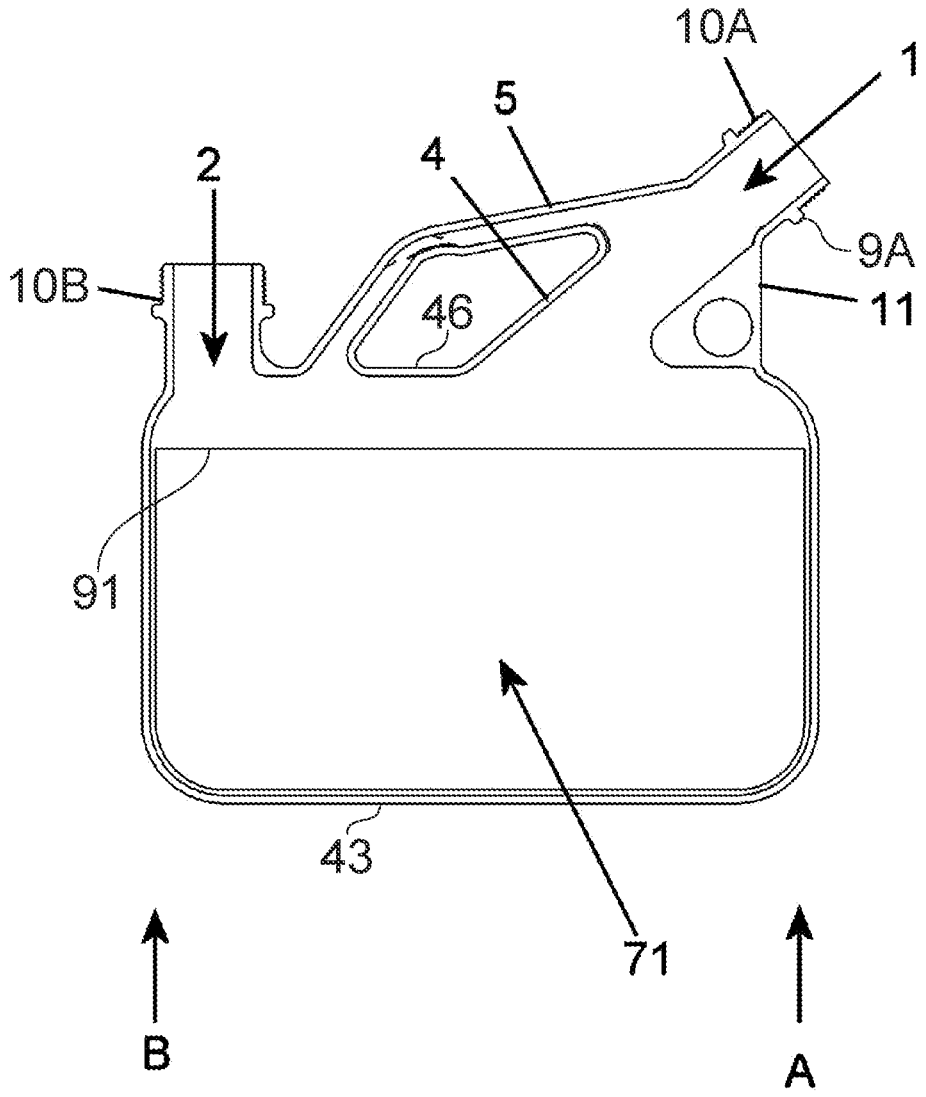
FIG. 6 shows a sectional view of the embodiment shown in FIG. 1, with lids removed.
Figure 7:
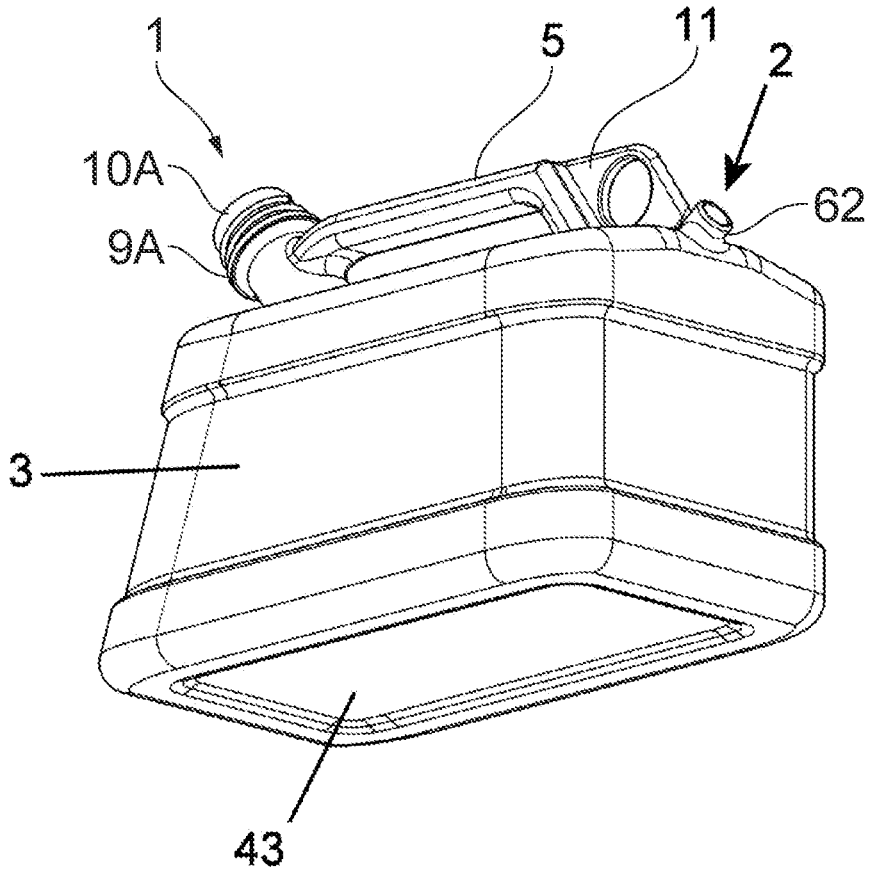
FIG. 7 shows a reverse isometric view of a second embodiment of the container according to the present invention.
Figure 8:
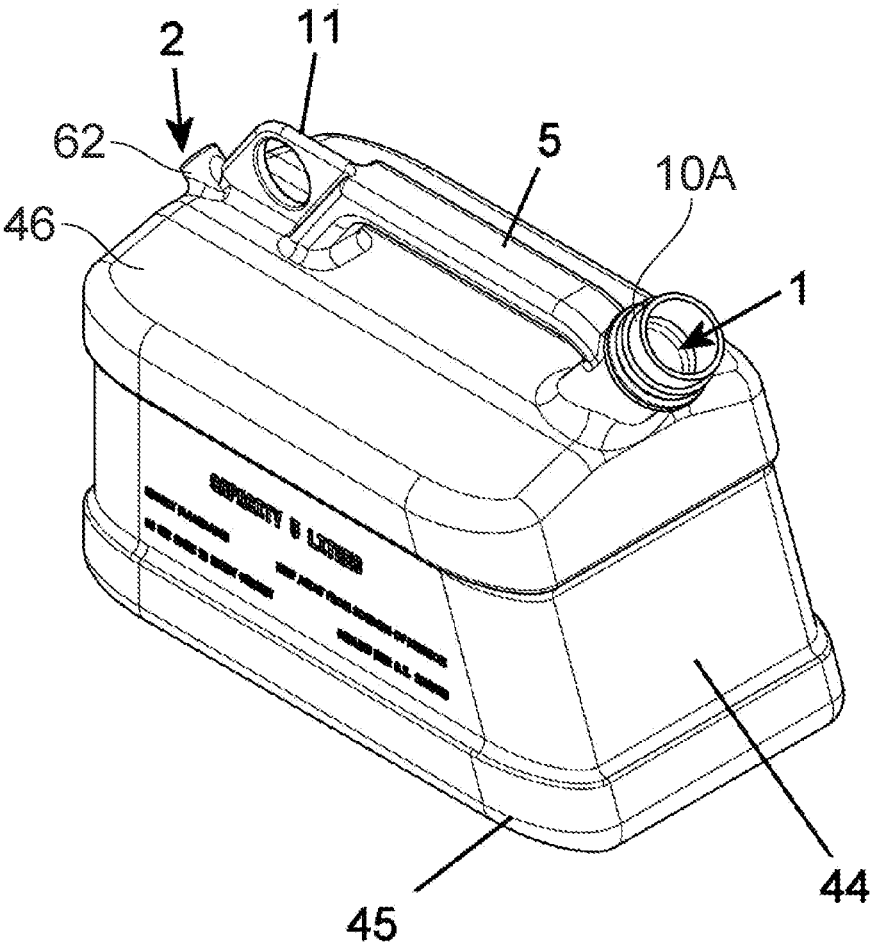
FIG. 8 shows an isometric view of the embodiment shown in FIG. 7.
Figure 9:
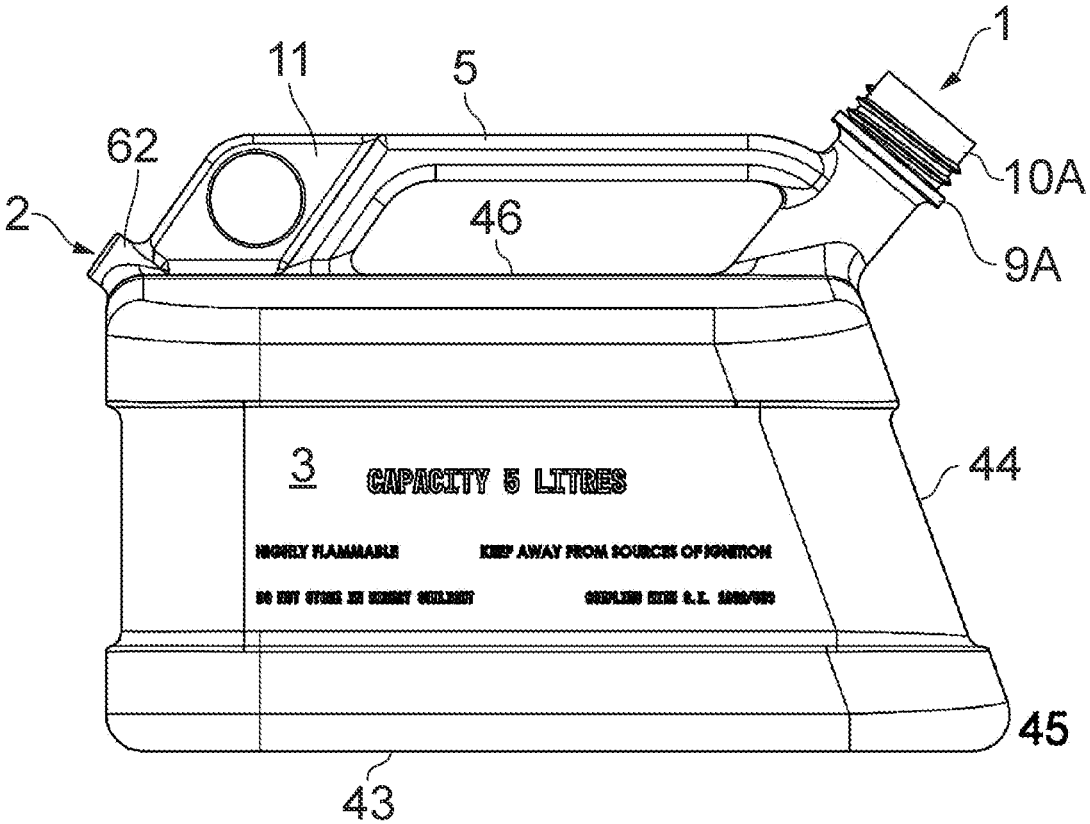
FIG. 9 shows a side view of the embodiment shown in FIG. 7.
Figure 10:
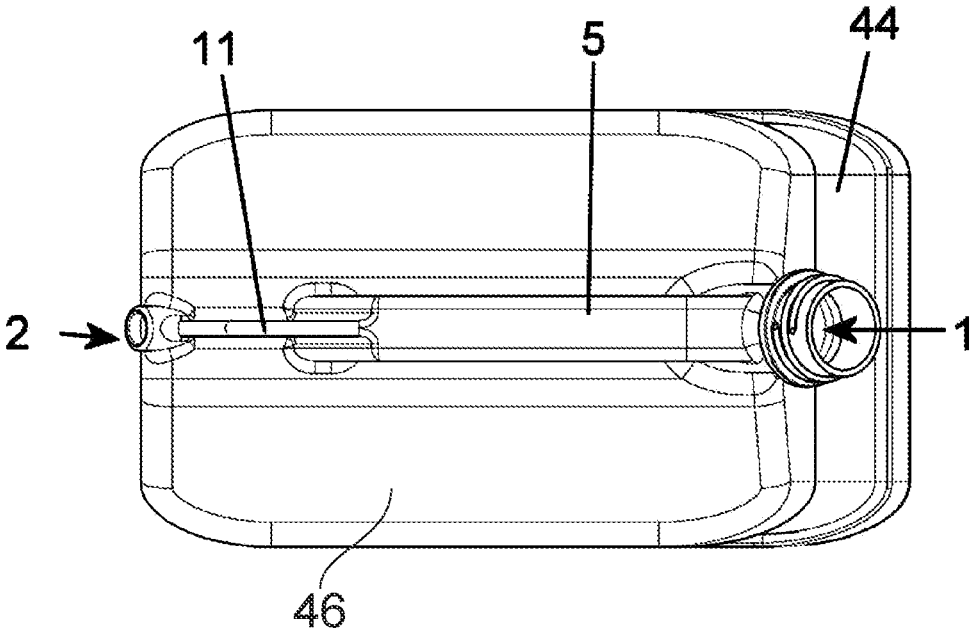
FIG. 10 shows a top view of the embodiment shown in FIG. 7.
Figure 11A:
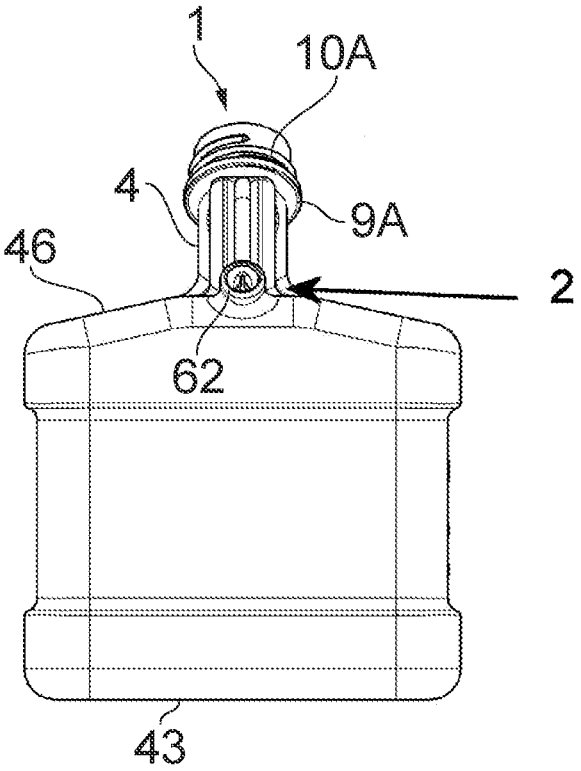
FIG. 11 show end views of the embodiment shown in FIG. 7.
Figure 11B:
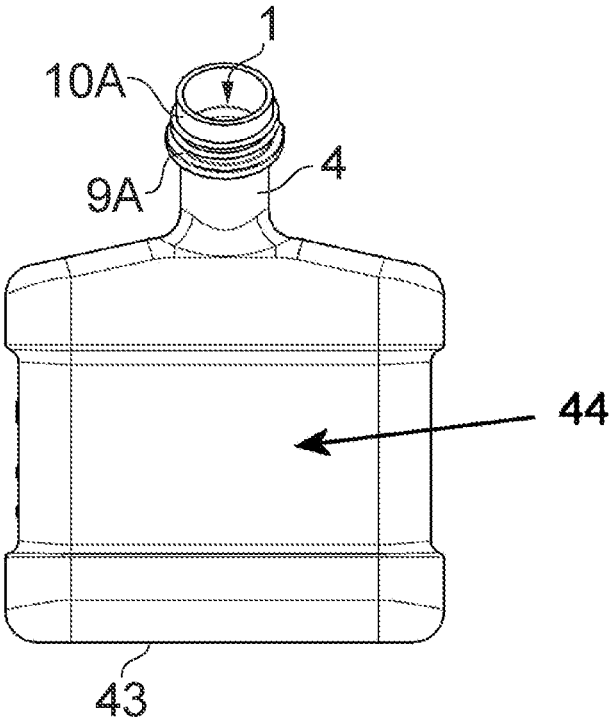

As shown in FIG. 6 and FIG. 13, the top surface of liquid in the interior volume 71 of the body 3 is level and parallel with the base 43 of the body when placed on a lever surface. The neck 4 is shown supporting the fuel dispenser nozzle 84 in the neck 4. This enables the fuel dispenser nozzle Venturi shutoff mechanism (not shown) to operate to shut off flow when the fuel liquid top surface rises to impinge on the dispenser nozzle tip. So advantageously, the container is filled without overflowing.

The length of the neck 4 from its opening into the body 3 to its open end of the neck 10A is preselected for filling the interior volume 71 automatically. The preselected length is between 99% and 50% of the length of a petrol or diesel fuel nozzle length. For example in FIG. 13, the neck 4 is shown about 90% the length of the nozzle. So when the fuel nozzle is fully inserted into the inlet 1, the fuel dispenser nozzle tip extends past the upper surface 46 of the body 3. The body may then be filled while resting on the base 43 until the liquid surface level 91 rises to just below the upper surface 46 of the body 3. As shown in FIGS. 6 and 13 the interior volume 71 is full of the surface level 91 of the liquid just below upper surface of the body.

Smooth pouring of fuel is ensured by opening vent 2. However, in some embodiments the gas pathway and ridges or a similar means are provided on an inner surface of the neck 4 which a passage for air to enter the container as fuel is being poured from it.

In this way the embodiments shown in FIGS. 1 to 11 and 13 are easier to use than existing fuel containers as well as providing a more secure inlet to the internal volume as the aperture provides an internal elongated neck.

The top fluid pathway 5 and the neck 4 separate towards the body 3, such that the user can insert their hand between these fluid pathways as a handle to carry the embodiment.

The body of the embodiment is inclined rearwards from the second end B in an inclined outer face 44, below the inlet 1, so as to limit toppling, for example when the nozzle is inserted in the inlet 1 and weight placed on the neck, inlet.

The body further comprises an indented base 43 and bumper edge 45, to aid in placement on the ground, and further discourage toppling, respectively.

With reference to FIG. 13 there is shown a container wherein the handle 5 is connected to the body of the container at a rearward end 66 and a forward end 67. At the forward end 67 the handle is also formed integrally with the neck 4. The first distal end 66 of the handle is connected to the body 3.

The fuel dispenser nozzle which comprises a first tubular portion 82 connected in series to a second tube 81. The first and second tubes are straight. The fuel dispenser nozzle has a bend 83 where the first tubular portion 82 is connected to the second tube 81. The first tubular portion 82 has a distal end from the bend 83 which is connected to the handle 85 of the fuel nozzle. The second tube 81 has a distal end 84 from the bend 83. This distal end 84 is the fuel discharge opening of the fuel nozzle.

The result is that when the fuel dispenser nozzle 84 is inserted into the neck 4 the tip of the nozzle 81 is oriented to face upper surface of the fuel and the each part of the nozzle 81, 82 and 83 are prevented form twisting when fully inserted in the neck 4 by way of a shoulder 61 defined by a junction with the material forming the handle and a throat portion where the neck 4 narrows. The shoulder 61 against which the dog-leg nozzle portion 83 rests, helps locate and orient the fuel dispenser nozzle 84 at a preselected distance in the neck, so that its tip touches an upper surface 91 of dispensed liquid fuel.

The connection of the handle 5 to the neck 4 forms a restriction 61 in the inlet 1. The restriction 61 places a bend in the neck 4. The bend in the neck 4 is about the same angle as the bend 83 in the fuel nozzle. So the restriction 63 in the neck 4 blocks the fuel dispenser nozzle at the bend 83. The discharge end 84 of the nozzle is conveniently located to the just below the surface level 91 of fuel when the inner volume 71 of the container 3 is full of fuel. For example, the correct full capacity of the fuel container may be 5, 10, or 25 litres. This can be seen in FIG. 13.

Figure 12A:
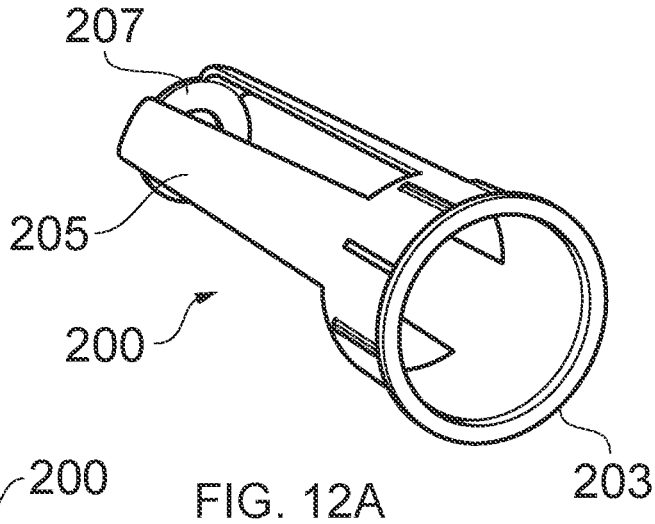
FIGS. 12A, 12B and 12C show views of an adaptor for insertion in inlets of some embodiments of the container to convert it for use from diesel to petrol.
Figure 12B:
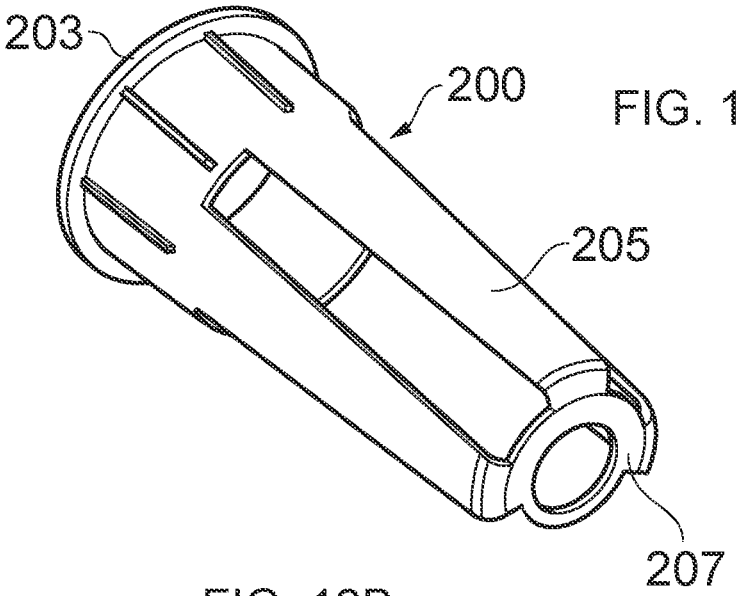
Figure 12C:
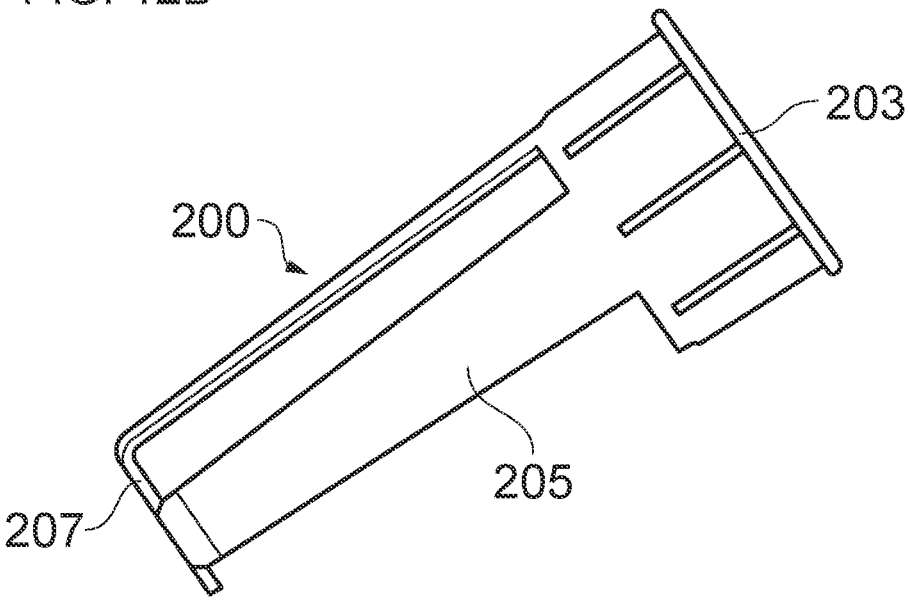

With reference to FIGS. 12A and 12B, there are shown views of an adaptor insert 55. The purpose of the adaptor insert 55 is to enable a fuel dispenser nozzle, from a petrol (gasoline) fuel pump, to be used with a fuel container, that was originally intended for use with diesel (derv), to be converted into a container for use with a petrol (gasoline) dispensing fuel nozzle. The adaptor insert 55 is arranged to be placed in a throat region of the inlet 1 of the neck 4.

In one embodiment when filling different embodiments of the container with petrol, the filling hose stops at the 'knuckle' of the hose. This allows for substantially filling the container to 5, 10, 15 or 25 litres of fuel into the fuel container before a Venturi effect causes the pump to shut off. Due to the different diameter of diesel hoses, such hoses can be pushed further into the container, thus causing much earlier shut-off (approx. 3 litres which is 2 litres earlier than 5 litres for example).

In this way the adaptor insert may stop the diesel hose from entering any further into the containers to allow for exactly 5 litres to be pumped without splashback or spillage.

The invention has been described by way of examples only, and it will be appreciated that variation may be made to the above-mentioned embodiments without departing from the protection as defined by the claims.

The invention claimed is:

1. A fuel container comprises:

a body for receiving fuel, the body has a handle and a dog-leg inlet with a neck that extends upwards, the dog-leg inlet presenting two different angles with respect to an upper surface of the body and has a threaded collar which is closable by a threaded cap, a length of the neck from an opening of the neck to the upper surface of the body defines a guide for receiving and orienting both legs of a dog-leg fuel dispenser nozzle in order to prevent the dog-leg fuel dispenser nozzle from twisting when fully inserted in the neck; and a shoulder, defined by a junction with material forming the handle and a throat region where the neck narrows, is provided to define an end stop in a lower leg of the dog-leg inlet, against which an upper leg of the dog-leg fuel dispenser nozzle rests when inserted in the neck;

the guide and the shoulder orient and locate the lower leg and the upper leg of the dog-leg fuel dispenser nozzle, at a preselected distance within the neck, so that an upper surface of liquid fuel dispensed in the fuel container causes a shutoff mechanism to trigger at a predefined volume of dispensed fuel.

2. The fuel container according to claim 1 wherein one of the two different angles at which the neck extends upwards is between 35° and 75° with respect to the upper surface of the body.

3. The fuel container according to claim 1 wherein the length of the neck from the opening, to the upper surface of the body, is between 5.5 and 11.0 centimetres.

4. The fuel container according to claim 1 wherein the length of the neck from the opening, to the upper surface of the body, is between 6.0 and 10.0 centimetres.

5. The fuel container according to claim 1 wherein the length of the neck from the opening, to the upper surface of the body, is between 5.5 and 11.0 centimetres.

6. The fuel container according to claim 1 wherein the length of the neck from the opening, to the upper surface of the body, is between 7.0 centimetres and 9.5 centimetres.

7. The fuel container according to claim 1 wherein the handle is located adjacent the neck and extends lengthwise along a top of the fuel container.

8. The fuel container according to claim 1 wherein a gas expansion pathway opens into the throat region of the neck.

9. The fuel container according to claim 8 wherein the gas expansion pathway is provided in a hollow within the handle.

10. The fuel container according to claim 1 wherein the guide includes one or more ribs disposed on an inner surface of the neck.

11. The fuel container according to claim 1 wherein the body has a larger base surface area than an area of the upper surface.

12. The fuel container according to claim 1 wherein the body comprises an inclined face which inclines rearwards from a base towards the dog-leg inlet.

13. The fuel container according to claim 11 wherein sides of the fuel container taper in the form of a trapezoidal prism.

14. The fuel container according to claim 8 wherein the gas expansion pathway comprises between 10% to 15% of the total available volume for the fuel in the fuel container.

15. The fuel container according to claim 1 wherein a restriction in the throat region is defined by a reduction in diameter of the throat region.

16. The fuel container according to claim 15 wherein the restriction in the throat region of the neck is defined by material that connects the handle to the body.

17. The fuel container according to claim 1 includes a closable vent.

18. The fuel container according to claim 17 wherein the vent is a pressure valve or cap.

19. The fuel container according to claim 1 includes an insert adapted to be placed in the throat region of the neck of the fuel container for converting the fuel container, intended for use with diesel (derv), for use with a petrol (gasoline) dispensing through the dog-leg fuel dispenser nozzle.

* * * * *